US010025249B2

(12) United States Patent
Noda

(10) Patent No.: US 10,025,249 B2
(45) Date of Patent: Jul. 17, 2018

(54) IMAGE FORMING DEVICE

(71) Applicant: Konica Minolta, Inc., Tokyo (JP)

(72) Inventor: Yoriko Noda, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/588,877

(22) Filed: May 8, 2017

(65) Prior Publication Data

US 2017/0336744 A1 Nov. 23, 2017

(30) Foreign Application Priority Data

May 18, 2016 (JP) ..... 2016-099187

(51) Int. Cl.
*G03G 15/00* (2006.01)

(52) U.S. Cl.
CPC ..... *G03G 15/5016* (2013.01); *G03G 15/50* (2013.01); *G03G 15/652* (2013.01); *G03G 2215/00455* (2013.01)

(58) Field of Classification Search
CPC ..... G03G 15/164; G03G 15/652; G03G 2215/00455; G03G 2215/00459; G03G 15/50; G03G 15/5016
See application file for complete search history.

(56) References Cited

U.S. PATENT DOCUMENTS 6,672,214 B1 * 1/2004 Bartholet ..... B41J 11/008 101/484
8,770,869 B2 * 7/2014 Nakamaru ..... B41J 11/485 358/1.15
9,400,471 B2 * 7/2016 Fukai ..... G03G 15/556
2011/0292443 A1 * 12/2011 Kamata ..... H04N 1/00482 358/1.15
2015/0314618 A1 * 11/2015 Ohashi ..... B41J 11/70 347/16
2016/0078331 A1 * 3/2016 Ikeda ..... B41J 15/00 358/1.14
2017/0299993 A1 * 10/2017 Kaminaka ..... G03G 15/50

FOREIGN PATENT DOCUMENTS

JP 2015-212051 A 11/2015

* cited by examiner

*Primary Examiner* — Carla Therrien
(74) *Attorney, Agent, or Firm* — Osha Liang LLP

(57) ABSTRACT

An image forming device is provided. The image forming device includes: a conveyance unit that conveys a continuous paper, an image forming unit that forms an image on a continuous paper conveyed by the conveyance unit, a job selection unit that selects a job to be executed, and a processor that calculates an image forming distance and indicates the calculated image forming distance on a display. The image forming distance is a length in a conveyance direction of the continuous paper needed to execute the selected job.

20 Claims, 10 Drawing Sheets

IMAGE FORMING DEVICE

The disclosure of Japanese Patent Application No. 2016-099187 filed on May 18, 2016 including the description, claims, drawings, and abstract are incorporated herein by reference in its entirety.

BACKGROUND

One or more embodiments of the present invention relate to an image forming device.

In the related art, there is a known an image forming device using a continuous paper like a roll paper, which includes: a paper feeding unit adapted to feed the continuous paper, a winding unit adapted wind up the continuous paper, and an image forming unit adapted to form an image on the continuous paper conveyed from the paper feeding unit to the winding unit.

In this kind of the image forming device, the device is put back to a reference state per job, and also adjustment processing to discharge toner is performed in order to replace deteriorated developer. However, since the continuous paper is moved in a conveyance direction even during such a period, a wasted blank space portion (waste) may be included between jobs.

In contrast, to reduce generation of a wasted paper between the jobs, proposed is a control unit that determines whether to provide a white space between jobs in accordance with a mode of a second job subsequent to a first job (refer to JP 2015-212051 A).

Meanwhile, in an image forming device using a continuous paper, it is difficult for a user to preliminarily grasp a consumption amount of the paper relative to a job that is to be executed.

SUMMARY

One or more embodiments of the present invention provide information related to a continuous paper use schedule accompanied by job execution in an image forming device adapted to form an image on the continuous paper.

According to one or more embodiments, an image forming device comprises: a conveyance unit that conveys a continuous paper; an image forming unit that forms an image on a continuous paper conveyed by the conveyance unit; a job selection unit to select a job to be executed; and a processor that calculates an image forming distance and indicates the calculated image forming distance on a display. The image forming distance is a length in a conveyance direction of the continuous paper needed to execute the selected job.

According to one or more embodiments, in the case where a plurality of jobs is selected by the job selection unit as a job to be executed, the control unit calculates a total image forming distance that is a length in the conveyance direction of the continuous paper needed to execute the selected plurality of jobs, and indicates the calculated total image forming distance on the display.

According to one or more embodiments, the control unit calculates the total image forming distance by using a preset inter-job blank space distance.

According to one or more embodiments, the image forming device further comprises a setting change unit to change the inter-job blank space distance.

According to one or more embodiments, the control unit indicates the inter-job blank space distance on the display.

According to one or more embodiments, the control unit displays an operation button to directly transition to a setting screen for the inter-job blank space distance on a screen on which the inter-job blank space distance is indicated.

According to one or more embodiments, the image forming device further comprises a designation unit that designates whether to consecutively execute the plurality of jobs relative to the selected plurality of jobs. In the case of designating consecutive execution of the plurality of jobs, the control unit calculates the total image forming distance by using a preset first inter-job blank space distance. In the case of not designating consecutive execution of the plurality of jobs, the control unit calculates the total image forming distance by using a second inter-job blank space distance longer than the preset first inter-job blank space distance.

According to one or more embodiments, the control unit indicates a remaining distance of the continuous paper after execution of the selected job on the display.

According to one or more embodiments, the image forming device further comprises an adjustment unit that executes adjustment accompanied by conveyance of the continuous paper at predetermined timing. The control unit indicates, on the display, a distance of the continuous paper corresponding to image forming until the predetermined timing.

According to one or more embodiments, the image forming unit forms an image by an electrographic method, and the adjustment consumes toner inside a developing unit.

According to one or more embodiments, the image forming device further comprises a switch command unit that commands switching of an indication on the display. In the case where switch of an indication is commanded by the switch command unit, the control unit indicates, on the display, the number of images corresponding to the image forming distance instead of the image forming distance.

According to one or more embodiments, the control unit sets a distance in the conveyance direction of the continuous paper as an axis and indicates, on the axis, an execution schedule of the selected job by using a length equivalent to an image forming distance corresponding to the job on the display.

According to one or more embodiments, in the case where a plurality of jobs is selected by the job selection unit as a job to be executed, the control unit indicates, on the axis, an execution schedule per the selected job by using a length equivalent to an image forming distance corresponding to the job on the display.

According to one or more embodiments, the control unit indicates, on the axis, a remaining distance of the continuous paper after execution of the selected job in a recognizable manner on the display.

According to one or more embodiments, the image forming device further comprises an adjustment unit that executes adjustment accompanied by conveyance of the continuous paper at predetermined timing. The control unit of the image forming device indicates, on the axis, a distance of the continuous paper corresponding to image forming until the predetermined timing in a recognizable manner on the display.

According to one or more embodiments, the control unit indicates an execution schedule of the selected job on a screen same as a job list adapted to select a job.

BRIEF DESCRIPTION OF THE DRAWINGS

The above aspects and features of one or more embodiments of the present invention will become more fully understood from the detailed description given hereinbelow and the appended drawings which are given by way of illustration only, and thus are not intended as a definition of the limits of one or more embodiments of the present invention, and wherein.

DETAILED DESCRIPTION

Hereinafter, one or more embodiments of the present invention will be described with reference to the drawings. However, the scope of the invention is not limited to the illustrated examples.

First, a structure of an image forming system according to one or more embodiments will be described.

Figure 1:
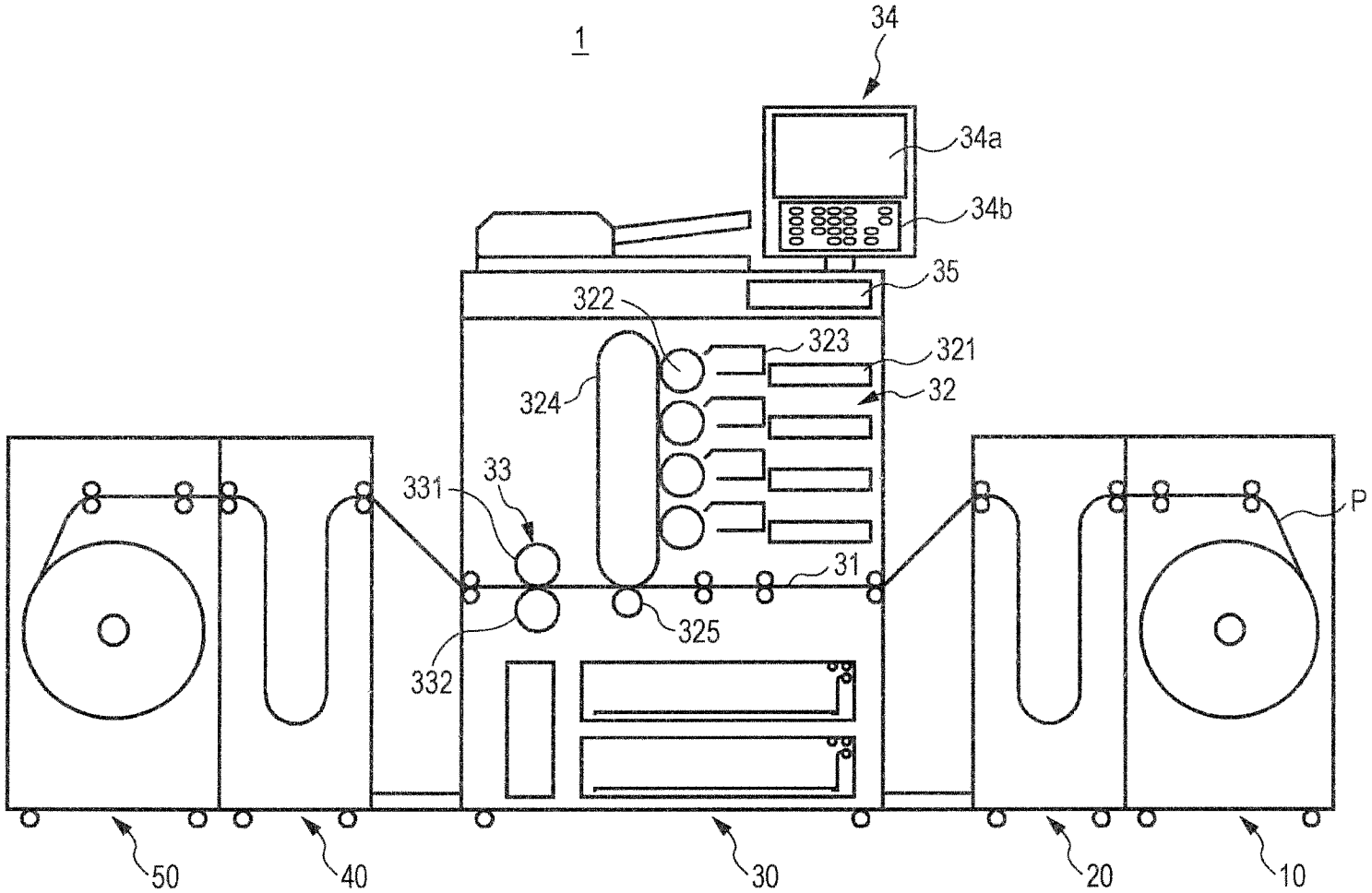
FIG. 1 is a schematic structural diagram illustrating an image forming system according to one or more embodiments.

FIG. 1 illustrates a schematic structure of an image forming system 1 in accordance with one or more embodiments.

In one or more embodiments, image forming system 1 is a system which uses a continuous paper (roll paper) P as a recording medium and forms an image on this continuous paper P.

As illustrated in FIG. 1, the image forming system 1 is formed by connecting a paper feeding device 10, a paper feeding adjustment device 20, an image forming device 30, a winding adjustment device 40, and a winding device 50 from an upstream side in a conveyance direction of the continuous paper P.

The paper feeding device 10 is a device to feed the continuous paper P to the image forming device 30. As illustrated in FIG. 1, the continuous paper P having a roll-like shape is wound around a support shaft and held in a rotatable manner inside a housing of the paper feeding device 10. In the paper feeding device 10, the continuous paper P wound around the support shaft is conveyed outside at a constant speed via a plurality of rollers. Furthermore, although only one continuous paper P is illustrated in FIG. 1, a plurality of continuous papers P may be held as well.

The paper feeding adjustment device 20 are set on a downstream side of the paper feeding device 10 and an upstream side of the image forming device 30 in the conveyance direction of the continuous paper P. The paper feeding adjustment device 20 is a device to convey the continuous paper P conveyed from the paper feeding device 10 to the image forming device 30, and holds the continuous paper P in a slackened manner in order to absorb a speed difference between a conveyance speed of the continuous paper P at the paper feeding device 10 and a conveyance speed of the continuous paper P at the image forming device 30, and adjusts feeding of the continuous paper P to the image forming device 30.

The image forming device 30 is a device having a function to form an image on the continuous paper P. The image forming devices 30 are set on a downstream side of the paper feeding adjustment device 20 and an upstream side of the winding adjustment device 40 in the conveyance direction of the continuous paper P.

The winding adjustment devices 40 are set on a downstream side of the image forming device 30 and an upstream side of the winding device 50 in the conveyance direction of the continuous paper P. The winding adjustment device 40 is a device to convey the continuous paper P conveyed from the image forming device 30 to the winding device 50, and holds the continuous paper P in a slackened manner in order to absorb a speed difference between the conveyance speed of the continuous paper P at the image forming device 30 and a conveyance speed of the continuous paper P at the winding device 50, and adjusts ejection of the continuous paper P from the image forming device 30.

The winding device 50 is a device to windup the continuous paper P conveyed from the image forming device 30 via the winding adjustment device 40. Inside a housing of the winding device 50, the continuous paper P is wound around a support shaft and held in a roll shape as illustrated in FIG. 1. In the winding device 50, the continuous paper P conveyed from the winding adjustment device 40 is wound around the support shaft at a constant speed via a plurality of rollers.

Next, a configuration of the image forming device 30 will be described in detail.

Figure 2:
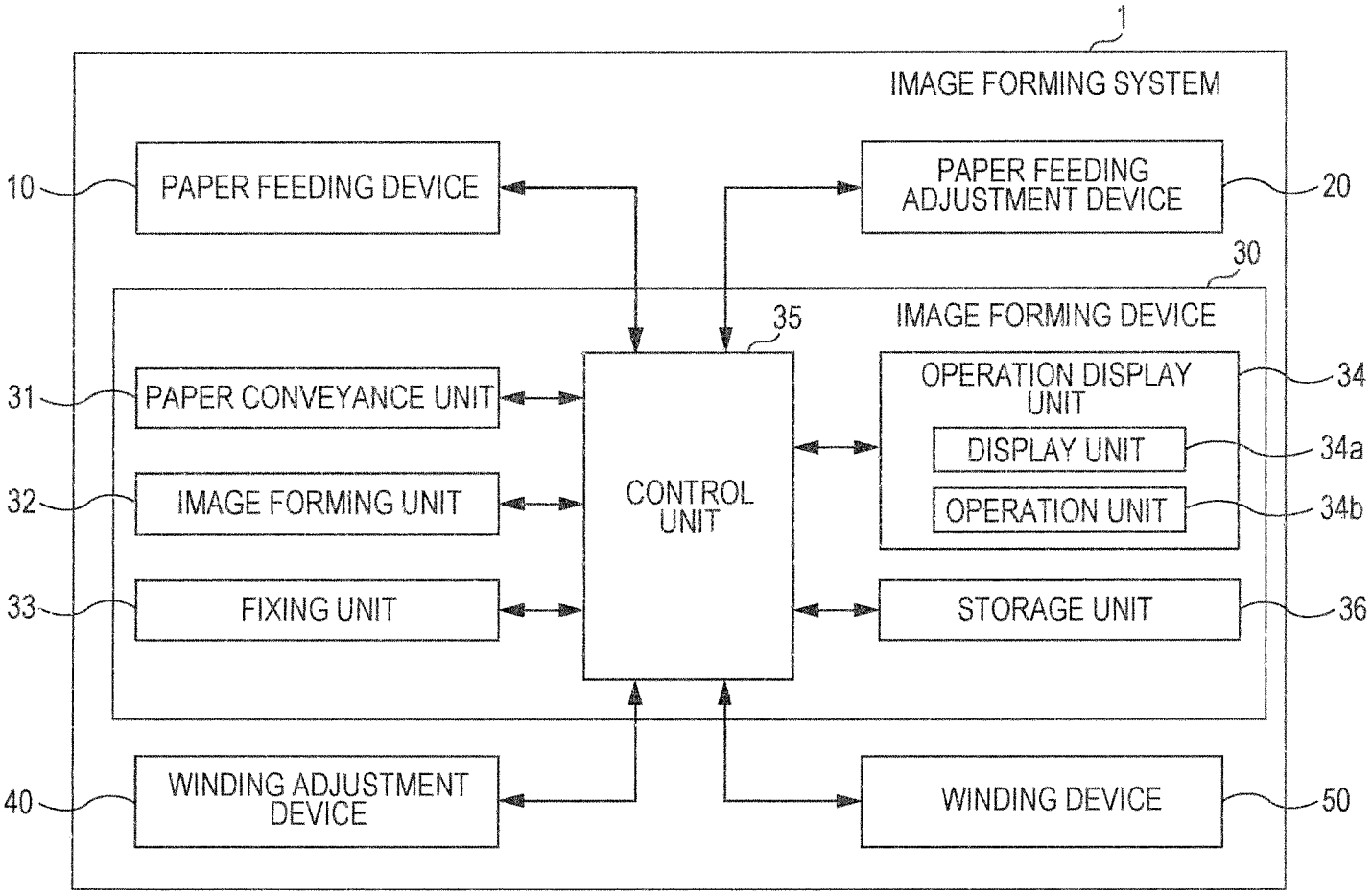
FIG. 2 is a functional block diagram illustrating a control configuration of the image forming system.

FIG. 2 is a functional block diagram illustrating a control configuration of the image forming system 1.

As illustrated in FIG. 2, the image forming device 30 includes a paper conveyance unit 31, an image forming unit 32, a fixing unit 33, an operation display unit 34, a control unit 35, and a storage unit 36.

In one or more embodiments, paper conveyance unit 31 is a conveyance mechanism for the continuous paper P inside the image forming device 30 and conveys the continuous paper P conveyed from the paper feeding adjustment device 20 to the image forming unit 32 by, for example, a plurality of rollers. The paper conveyance unit also conveys the continuous paper P having passed the image forming unit 32 and the fixing unit 33 to the winding adjustment device 40.

The image forming unit 32 forms an image on the continuous paper P conveyed from the paper conveyance unit 31.

The image forming unit 32 forms a toner image by an electrographic method, and transfers the same to the continuous paper P. The image forming unit 32 includes four sets of exposure units 321, photoreceptors 322, and developing units 323 corresponding to respective color components of yellow (Y), magenta (M), cyan (C), and black (K), and further includes an intermediate transfer belt 324, and a transfer roller 325 (refer to FIG. 1).

The exposure unit 321 emits laser beams on the charged photoreceptor 322 and forms an electrostatic latent image on the photoreceptor 322 by exposure. The developing unit 323 develops the electrostatic latent image formed on the photoreceptor 322 by supplying toner of a predetermined color (Y, M, C or K) onto the photoreceptor 322 subjected to exposure by a development roller.

A toner image of each color (single color image) formed on the photoreceptor 322 of each color of Y, M, C, K is successively transferred onto the intermediate transfer belt 324, and a toner image on which layers of respective colors are superimposed is formed (color image). The intermediate transfer belt 324 is an endless belt rotated around by a plurality of rollers. Then, bias voltage having reverse polarity of the toner is applied to the transfer roller 325, thereby transferring the toner image formed on the intermediate transfer belt 324 onto the continuous paper P.

The fixing unit 33 fixes the toner image transferred onto the continuous paper P.

The fixing unit 33 includes a pair of rollers formed of a heat roller 331 and a pressure roller 332 adapted to nip the continuous paper P (refer to FIG. 1).

The heat roller 331 is heated to a predetermined temperature by a heater, namely, a heating source.

The pressure roller 332 is biased toward the heat roller 331 by an elastic member not illustrated. The continuous paper P to which the toner image has been transferred passes through a nip portion between the heat roller 331 and the pressure roller 332, thereby applying heat and pressure to the continuous paper, and the toner image is melted and fixed on the continuous paper P.

The operation display unit 34 includes: a display unit 34*a* adapted to indicate various kinds of information on a display screen; and an operation unit 34*b* used to input various kinds of commands by a user. The operation unit 34*b* may have a structure including a touch panel formed in a manner covering the display screen of the display unit 34*a*.

For example, the operation unit 34*b* is used at the time of selecting a job to be executed, at the time of changing an inter-job blank space distance, at the time of designating whether to consecutively execute a plurality of jobs related to the selected plurality of jobs, and at the time of commanding switch of an indication on the display unit 34*a*. In other words, the operation unit 34*b* functions as a job selection unit, a setting change unit, a designation unit, and a switch command unit.

The display unit 34*a* indicates an image forming distance, a total image forming distance, an inter-job blank space distance, and so on.

The control unit 35 is formed of a central processing unit (CPU) (i.e., a processor), a random access memory (RAM), and the like. The CPU of the control unit 35 reads various kinds of programs such as a system program and a processing program stored in the storage unit 36, decompresses the same in the RAM, and executes various kinds of processing in accordance with the decompressed programs.

The storage unit 36 is formed of, for example, a hard disk drive (HDD), a semiconductor non-volatile memory, and the like.

The storage unit 36 stores: the various kinds of programs such as the system programs and processing programs executed in the control unit 35; and data needed to execute these programs. For example, the storage unit 36 stores a first inter-job blank space distance, a second inter-job blank space distance, a consecutive image-forming upper limit distance, and the like.

The control unit 35 calculates an image forming distance that is a length in the conveyance direction of the continuous paper P needed to execute a selected job, and indicates the calculated image forming distance on the display unit 34*a*.

Figure 3:
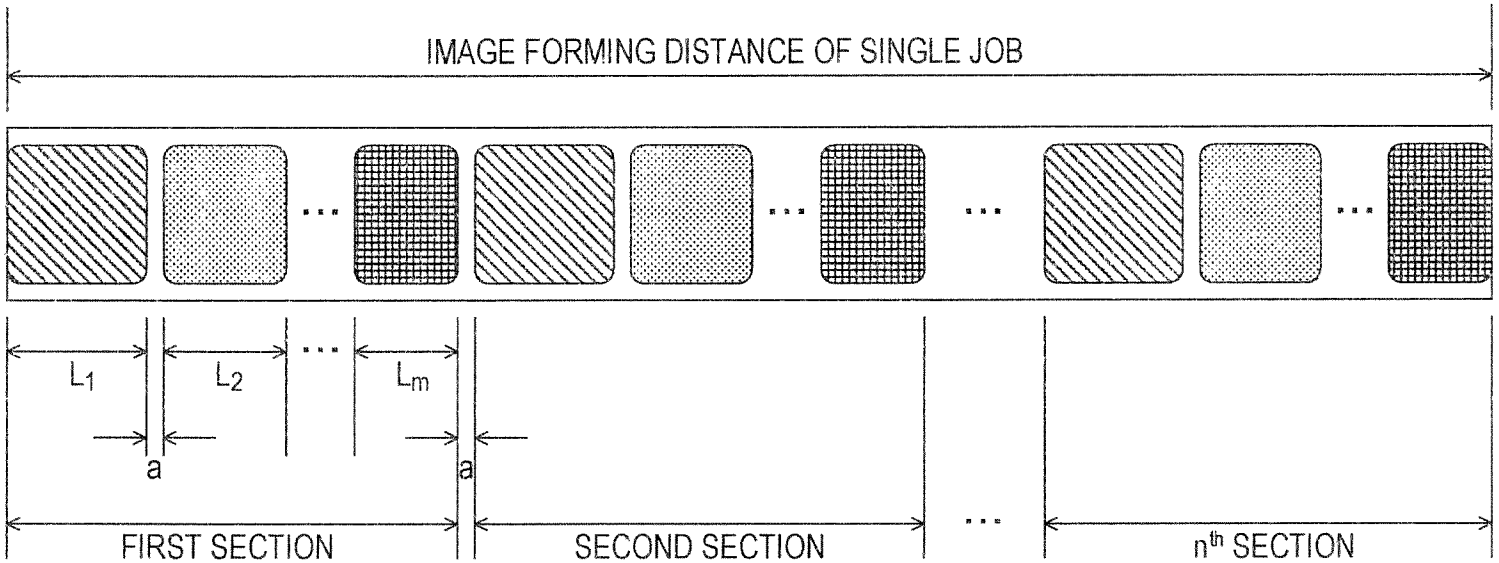
FIG. 3 is a diagram illustrating an output image in the case where a single job is selected.

FIG. 3 is an output image in the case where one job (single job) is selected.

Job information received from an external apparatus includes: a length of an image (image length) in the conveyance direction of the continuous paper P per image included in the job; and the number of sections.

An image forming distance of the single job is acquired as follows while defining the number of images per section in the job as m, the number of sections as n, an image length of $i^{th}$ image as $L_i$, and an interval between images as a (such as 1 mm).

$$\text{Image forming distance}=(L_1+a+L_2+a+\ldots+L_m)+a+(L_1+a+L_2+a+\ldots L_m)+a+\ldots+(L_1+a+L_2+a+\ldots+L_m)=(L_1+L_2+\ldots+L_m)\times n+a\times(m\times n-1)$$

Here, the same value (image interval a) is used for both of an interval between images in the same section and an interval between images in the different sections. However, different values may also be used for the interval between the images in the same section and the interval between the images in the different sections at the time of calculating the image forming distance.

In the case where a plurality of jobs is selected as jobs to be executed, the control unit 35 calculates a total image forming distance that is a length in the conveyance direction of the continuous paper P needed to execute the selected plurality of jobs, and indicates the calculated total image forming distance on the display unit 34*a*.

At this point, the control unit 35 calculates the total image forming distance by using a preset inter-job blank space distance.

In the case where consecutive execution of the plurality of jobs is designated (consecutive jobs), the control unit 35 calculates a total image forming distance by using a preset first inter-job blank space distance, and in the case where consecutive execution of the plurality of jobs is not designated (plurality of jobs), the control unit calculates a total image forming distance by using a preset second inter-job blank space distance. The second inter-job blank space distance is longer than the first inter-job blank space distance.

"Consecutive execution of the plurality of jobs" means to execute a plurality of jobs without stopping the image forming device 30 per job as if executing a series of jobs. In the case of performing "consecutive execution of the plurality of jobs", operation to put back the device to a reference state per job is not performed, and adjustment processing is not inserted per job.

Figure 4:
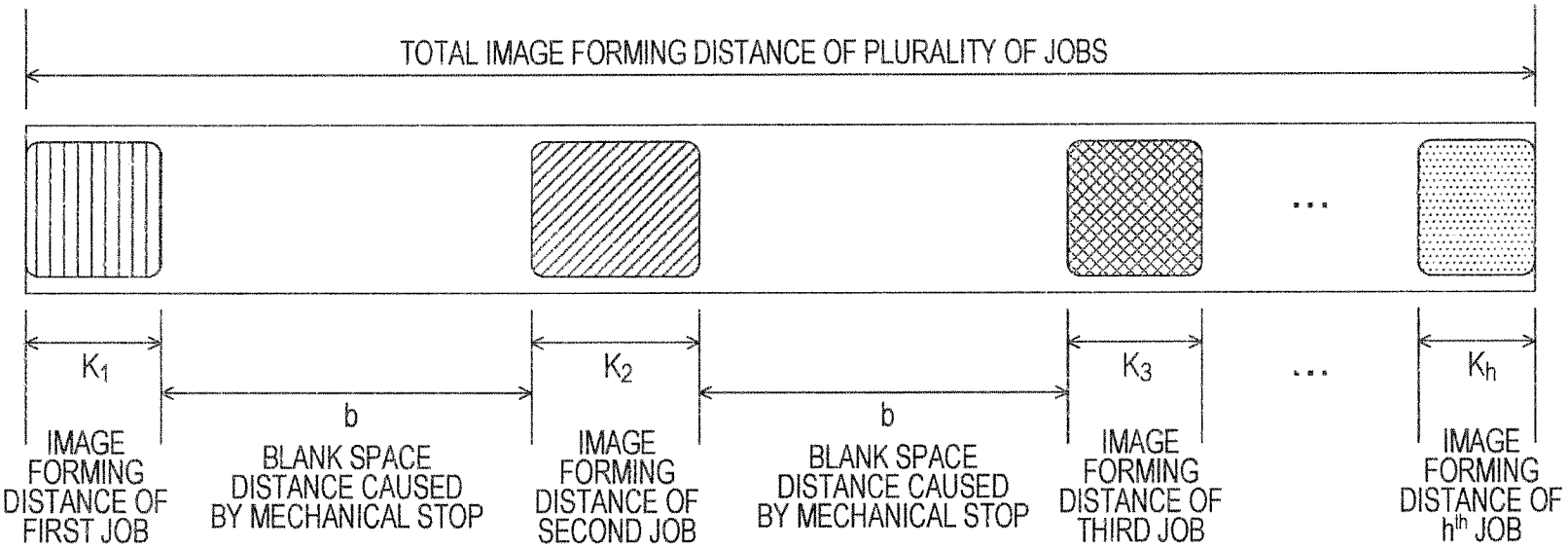
FIG. 4 is a diagram illustrating an output image in the case where a plurality of jobs is selected.

FIG. 4 illustrates an output image in the case where a plurality of jobs is selected.

A total image forming distance of the plurality of jobs is acquired as follows while defining the number of jobs included in the plurality of jobs as h, an image forming distance of $j^{th}$ job as $K_j$, and a blank space distance caused by mechanical stop as b (second inter-job blank space distance, such as 4 to 5 m).

$$\text{Total image forming distance}=K_1+b+K_2+b+\ldots+b+K_h=(K_1+K_2+\ldots+K_h)+b\times(h-1)$$

During mechanical stop, the image forming device 30 is put back to the reference state by lowering a temperature at the fixing unit 33 and the like, and also adjustment processing is performed.

Figure 5:
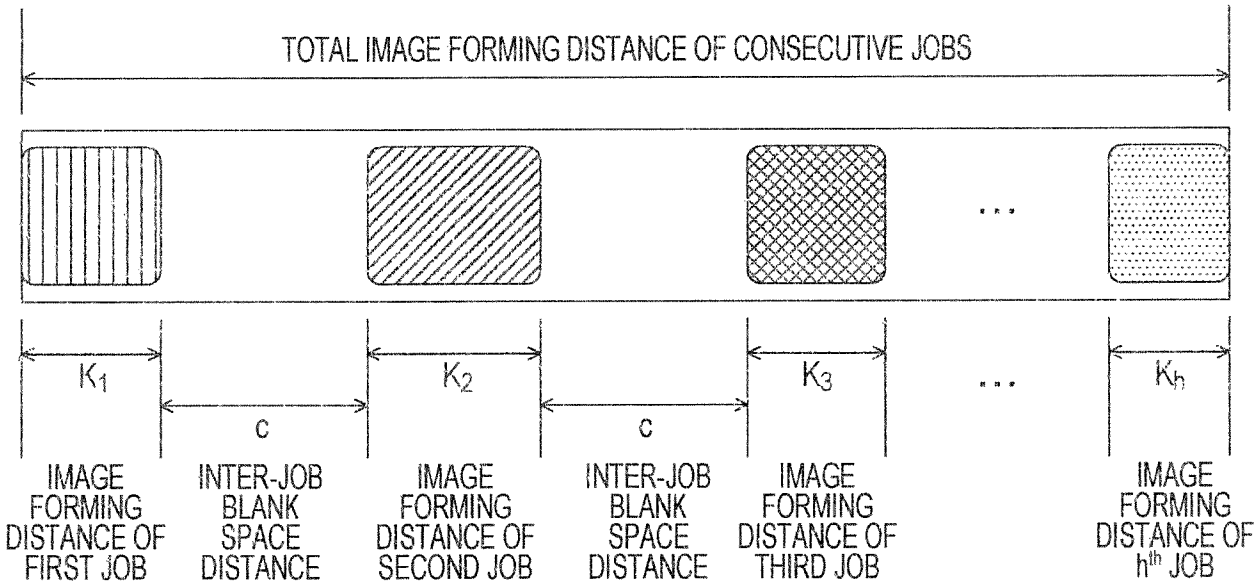
FIG. 5 is a diagram illustrating an output image in the case where consecutive jobs are selected.

FIG. 5 illustrates an output image in the case where consecutive jobs are selected.

A total image forming distance of the consecutive jobs is acquired as follows while defining the number of jobs included in the consecutive jobs as h, an image forming distance of $j^{th}$ job as $K_j$, and an inter-job blank space distance designated by a user (first inter-job blank space distance, such as 2 m) as c (c<b).

$$\text{Total image forming distance}=K_1+c+K_2+c+\ldots+c+K_h=(K_1+K_2+\ldots+K_h)+c\times(h-1)$$

The control unit 35 indicates the inter-job blank space distance on the display unit 34*a*.

Figure 6:
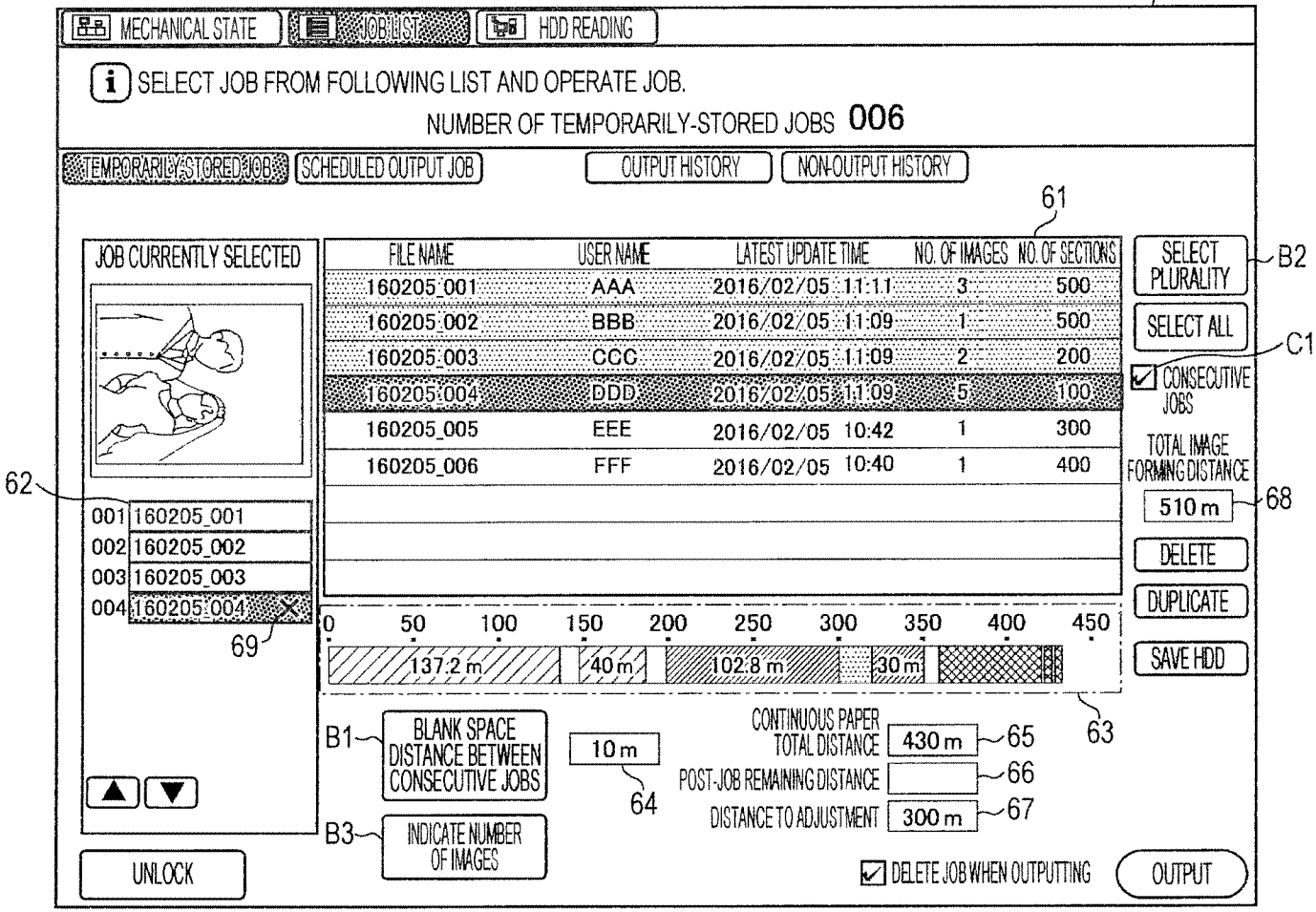
FIG. 6 is an exemplary display of a job list screen.

The control unit 35 displays an operation button (button to set a blank space distance between consecutive jobs B1) in order to directly transition to an inter-job blank space distance setting screen (refer to FIG. 7) on a screen where the inter-job blank space distance is indicated (e.g., job list screen 341 illustrated in FIG. 6).

The control unit 35 indicates, on the display unit 34*a*, a remaining distance of the continuous paper P after execution of a selected job.

The control unit 35 executes adjustment accompanied by conveyance of the continuous paper P at predetermined timing. In other words, the control unit 35 functions as an adjustment unit. Here, adjustment is adapted to consume toner inside the developing unit 323 in the image forming unit 32, and is the processing to discharge the toner to replace deteriorated developer and forma patch image on the intermediate transfer belt 324. As the predetermined timing, a consecutive image-forming upper limit distance (such as 300 m) is preliminarily set. In the case where image forming is performed by the consecutive image-forming upper limit distance on the continuous paper P after adjustment, the control unit 35 performs next adjustment. When adjustment is performed, an adjustment counter to accumulate image forming distances is reset.

Furthermore, in the cases of single job and a normal plurality of jobs, the control unit 35 performs adjustment every time a job is finished. In the case where consecutive jobs are designated, the control unit 35 omits adjustment when each job included in the consecutive jobs is finished, and performs adjustment every time image forming by the consecutive image-forming upper limit distance is finished.

The control unit 35 indicates, on the display unit 34*a*, a distance of the continuous paper P corresponding to image forming until predetermined timing (adjustment timing).

In the case where a command is made to switch an indication on the display unit 34*a*, the control unit 35 indicates, on the display unit 34*a*, the number of images corresponding to the image forming distance instead of the image forming distance.

The control unit 35 sets a distance in the conveyance direction of the continuous paper P as an axis, and indicates, on this axis, an execution schedule of a selected job on the display unit 34*a* by using a length equivalent to an image forming distance corresponding to the job.

In the case where a plurality of jobs is selected as jobs to be executed, the control unit 35 indicates, on the axis, an execution schedule per selected job on the display unit 34*a* by using a length equivalent to an image forming distance corresponding to the job.

The control unit 35 indicates the execution schedule of the selected job inside a screen same as the job list adapted to select a job.

The control unit 35 indicates, on the axis, a remaining distance of the continuous paper P after execution of the selected job in a recognizable manner on the display unit 34*a*.

The control unit 35 indicates, on the axis, a distance of the continuous paper P corresponding to image forming until the predetermined timing in a recognizable manner on the display unit 34*a*.

FIG. 6 is an exemplary display of the job list screen 341 displayed on the display unit 34*a*.

The job list screen 341 includes a temporarily-stored job list indication area 61, a selected job indication area 62, a job execution schedule indication area 63, an indication area for a blank space distance between consecutive jobs 64, a continuous paper total distance indication area 65, a post-job remaining distance indication area 66, an indication area for a distance to adjustment 67, a total image forming distance indication area 68, a button to set a blank space distance between consecutive jobs B1, a button to select a plurality of jobs B2, a button to indicate number of images B3, a consecutive-job check box C1, and the like.

In the temporarily-stored job list indication area 61, job information of temporarily-stored jobs is listed in a received order. The temporarily-stored job is a job in a waiting state among jobs for which image forming commands are transmitted to the image forming device 30. The job information includes a file name, a user name, latest update time, the number of images, the number of sections, and the like.

In the selected job indication area 62, a file name of a job selected by a user from among the jobs listed in the temporarily-stored job list indication area 61 is indicated in a selected order. In the selected job indication area 62, as for a job that cannot be executed due to shortage of the paper, a mark 69 notifying such a situation is indicated.

In the job execution schedule indication area 63, a distance in the conveyance direction of the continuous paper P is set as an axis, and an execution schedule of a selected job is indicated on the axis by using a length equivalent to an image forming distance corresponding to the job (scale indication).

In the indication area for a blank space distance between consecutive jobs 64, an inter-job blank space distance set at an inter-job blank space distance setting screen 342 (refer to FIG. 7) is indicated.

In the continuous paper total distance indication area 65, a total distance of the continuous paper P (value obtained by subtracting a used distance from an initial value of the length in the conveyance direction of the continuous paper P) is indicated.

In the post-job remaining distance indication area 66, a remaining distance of the continuous paper P after execution of the selected job is indicated.

In the indication area for a distance to adjustment 67, a distance of the continuous paper P corresponding to image forming until the adjustment timing is indicated.

In the total image forming distance indication area 68, in the case where a plurality of jobs is selected, a total image forming distance is indicated, and in the case where one job is selected, an image forming distance is indicated.

In the button to set a blank space distance between consecutive jobs B1 is a button to set an inter-job blank space distance (first inter-job blank space distance) in the consecutive jobs. When a user presses the button to set a blank space distance between consecutive jobs B1 by operation from the operation unit 34*b*, the control unit 35 displays the inter-job blank space distance setting screen 342 (refer to FIG. 7) on the display unit 34*a*.

The button to select a plurality of jobs B2 is a button to be pressed at the time of selecting a plurality of jobs from among temporarily stored jobs indicated in the temporarily-stored job list indication area 61.

The consecutive-job check box C1 is used at the time of designating whether to consecutively execute the plurality of jobs in the case where the plurality of jobs is selected. In the case of consecutively executing the plurality of jobs, the user puts a check in the consecutive-job check box C1 by operation from the operation unit 34*b*.

The button to indicate number of images B3 is a button to switch an indication between an indication using a distance and an indication using the number of images as for a value corresponding to an execution schedule of a job indicated in the job execution schedule indication area 63. The button to indicate number of images B3 is a toggle button, and when the button is pressed during the indication using a distance, the indication manner is switched to the indication using the number of images, and also the button to indicate number of images B3 is changed to a button to indicate a distance. On the other hand, when the button to indicate a distance is pressed during the indication using the number of images, the indication is switched to the indication using a distance, and also the button to indicate a distance is changed to the button to indicate number of images B3.

Figure 7:
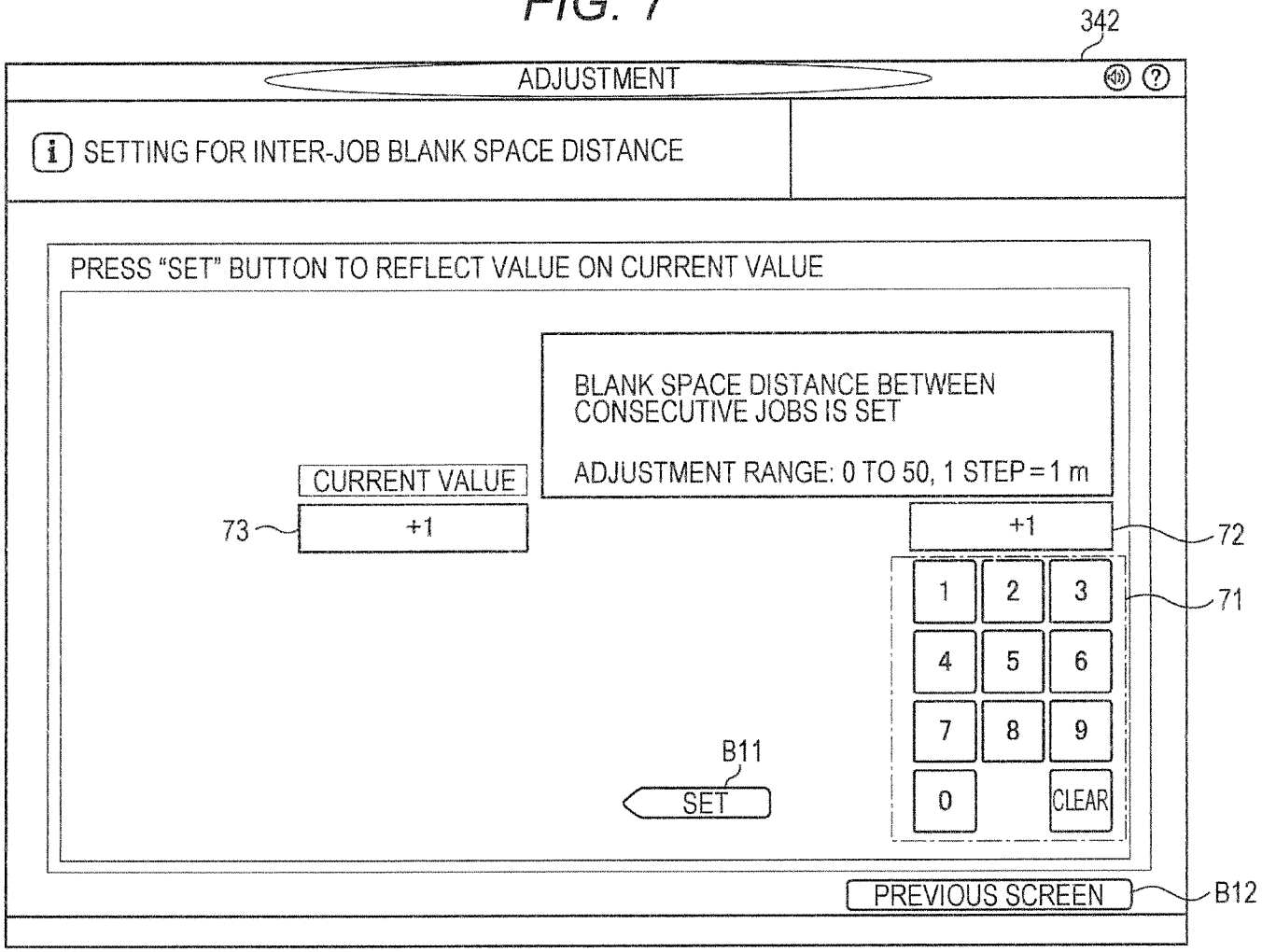
FIG. 7 is an exemplary display of an inter-job blank space distance setting screen.

FIG. 7 illustrates an exemplary display of an inter-job blank space distance setting screen 342.

The inter-job blank space distance setting screen 342 includes a number input key group 71, an input value indication area 72, a current value indication area 73, a set button B11, a previous screen button B12, and the like.

The number input key group 71 corresponds to keys to input an inter-job blank space distance (value) of consecutive jobs In the input value indication area 72, a value input from the number input key group 71 is indicated.

The set button B11 is a button to settle the input value.

In the current value indication area 73, a value of the inter-job blank space distance currently set is indicated. When the set button B11 is pressed in a state that the value input from the number input key group 71 is indicated in the input value indication area 72, the input value is reflected on the current value indication area 73 and also stored in the storage unit 36 as a new inter-job blank space distance (first inter-job blank space distance).

The previous screen button B12 is a button to transition to a previous screen (job list screen 341). When a user presses the previous screen button B12 by operation from the operation unit 34*b*, the control unit 35 displays the job list screen 341 on the display unit 34*a*.

As illustrated in FIG. 6, in the case where the consecutive-job check box C1 is checked in the job list screen 341, a selected plurality of jobs is processed as consecutive jobs. An inter-job blank space distance set in the inter-job blank space distance setting screen 342 is inserted between the jobs included in the consecutive jobs.

Figure 8A:
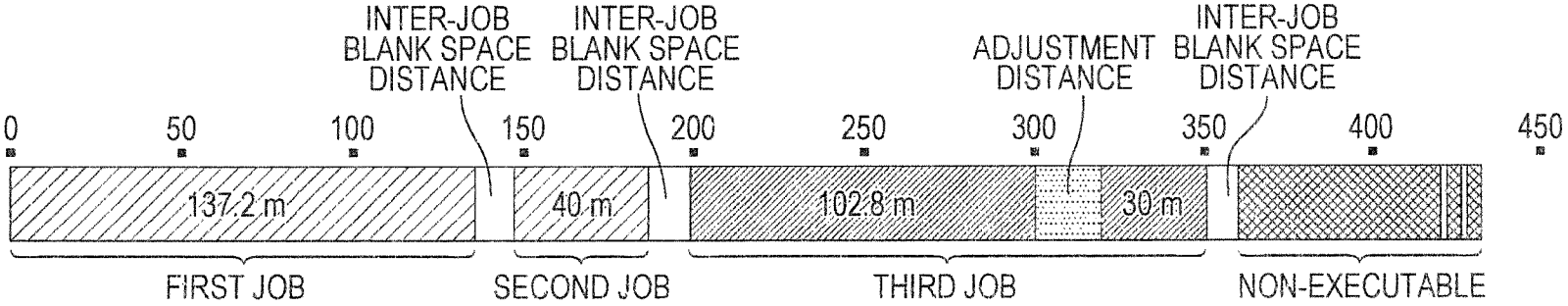
FIG. 8A is an enlarged view of a job execution schedule indication area in the job list screen.

FIG. 8A is an enlarged view of the job execution schedule indication area 63 in the job list screen 341 illustrated in FIG. 6. In the job execution schedule indication area 63, a distance in the conveyance direction of the continuous paper P is set as an axis, and an execution schedule of a selected job is indicated on the axis by using a length equivalent to an image forming distance corresponding to the job on the display unit 34*a*.

In the example illustrated in FIG. 8A, a used paper distance does not reach a consecutive image-forming upper limit distance (300 m) even after execution of a first job (137.2 m) and a second job (40 m). Therefore, execution schedules corresponding to the first job and the second job are indicated by a first color (such as blue).

An interval between the first job and the second job, an interval between the second job and a third job, and an interval between the third job and a fourth job are indicated by a second color (such as pale blue) by an amount corresponding to the inter-job blank space distance.

Since the used paper distance reaches the consecutive image-forming upper limit distance (300 m) in the middle of the third job (when image forming by 102.8 m is finished out of 132.8 m), an execution schedule corresponding to the third job is indicated by a third color (such as yellow).

Additionally, a distance corresponding to adjustment processing inserted into the middle of the third job (adjustment distance) is indicated by a fourth color (such as pale yellow).

Since the fourth job cannot be executed due to shortage of the paper, this job is indicated by a fifth color (such as red).

Figure 8B:
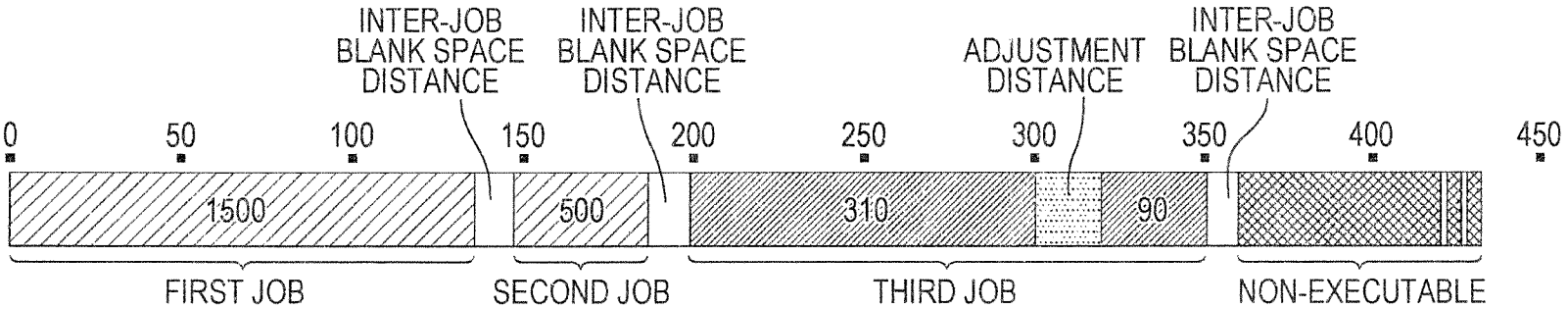
FIG. 8B is an exemplary display in the case where the job execution schedule indication area is switched to an indication using the number of images.

When the button to indicate number of images B3 is pressed in the job list screen 341 illustrated in FIG. 6, the indication in the job execution schedule indication area 63 is switched to the indication using the number of images as illustrated in FIG. 8B. Specifically, the number of images such as "1500" is indicated as an execution schedule of the first job, and the number of images such as "500" is indicated as an execution schedule of the second job. Additionally, a fact that the used paper distance reaches the consecutive image-forming upper limit distance in the middle of the third job (at the time of finishing image forming for 310 pieces out of 400 pieces of images) is indicated. Here, note that scale marks for distance indication are kept as they are. Furthermore, color coding is the same as FIG. 8A.

At the time of converting an image forming distance to the number of images for each job to be executed, scheduled number of images formed by image forming in the job is calculated in the case where image forming for all of images included in a job is executable. For example, in the case of defining the number of images per section included in a job as m and defining the number of sections as n, the number of images results in m×n.

In the case where adjustment is inserted into the middle of the job, the number of images before the adjustment is calculated from an image forming distance before the adjustment, and the number of images after the adjustment is calculated from an image forming distance after the adjustment.

Figure 9:
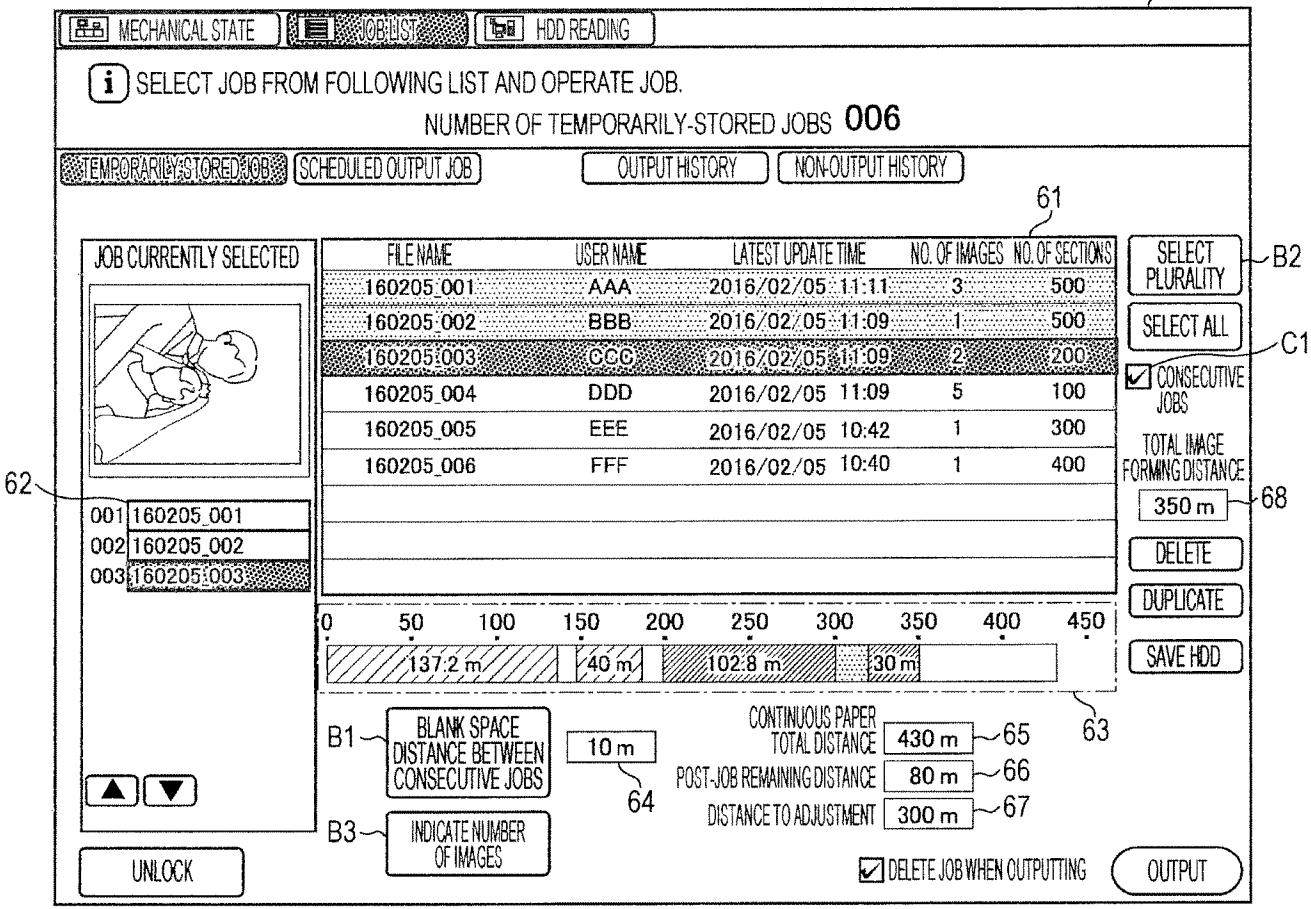
FIG. 9 is another exemplary display of the job list screen.

FIG. 9 is an exemplary display of the job list screen 343 in the case where all of selected jobs are executable. Reference signs inside the job list screen 343 are the same as FIG. 6. For example, "350 m" is indicated as a total image forming distance of three selected jobs in the total image forming distance indication area 68. In the post-job remaining distance indication area 66, "80 m" is indicated. This is a value obtained by subtracting the total image forming distance "350 m" from a continuous paper total distance "430 m" indicated in the continuous paper total distance indication area 65.

Next, operation in the image forming system 1 will be described.

Figure 10:
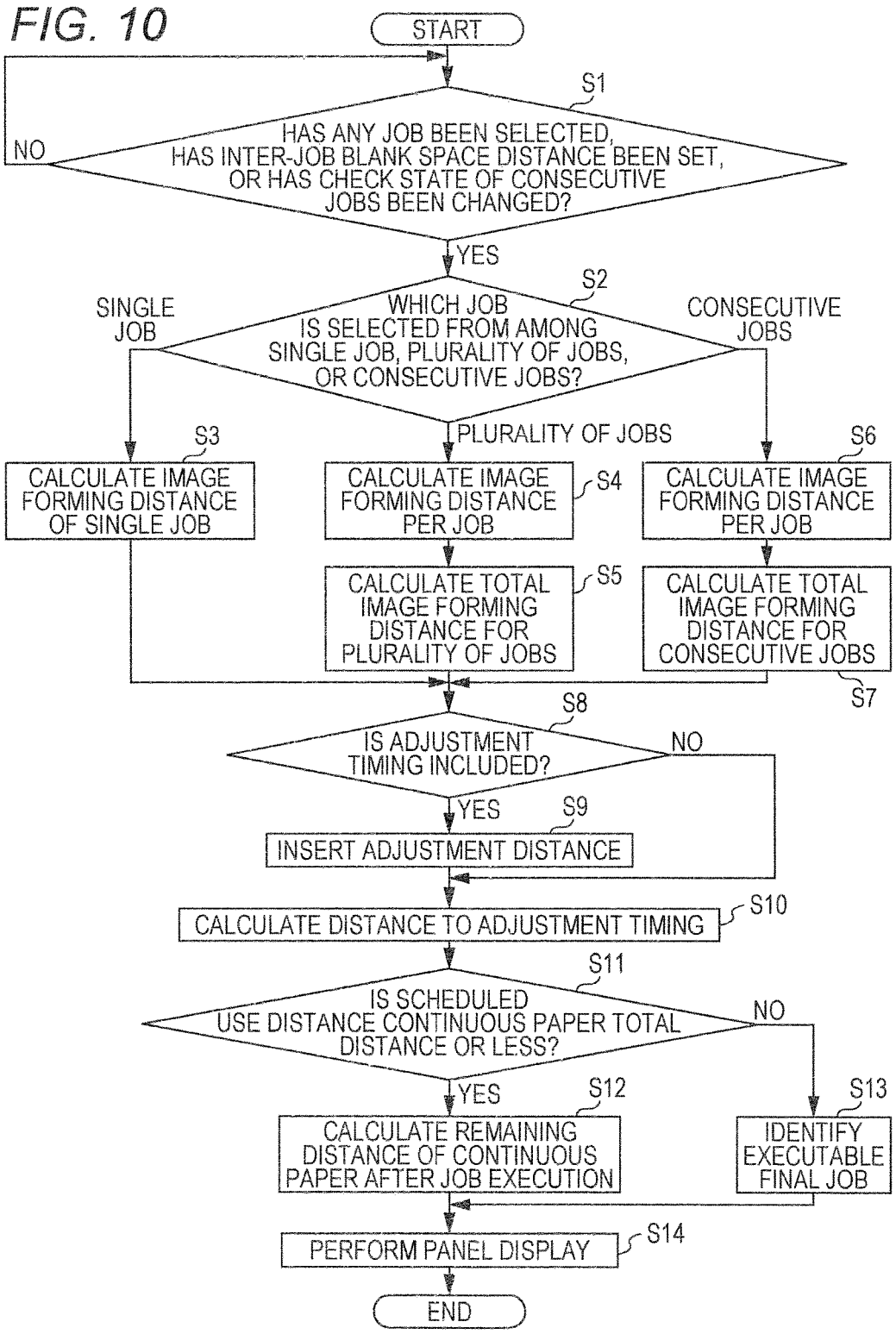
FIG. 10 is a flowchart illustrating job schedule display processing.

FIG. 10 is a flowchart illustrating job schedule display processing.

First, in the job list screen displayed on the display unit 34*a*, the control unit 35 determines whether any job to be executed has been selected, an inter-job blank space distance relative to consecutive jobs has been set, or a check state of consecutive jobs has been changed by user's operation from the operation unit 34*b* (Step S1). For example, it is determined whether a job to be executed has been added or deleted (whether any change has been made on a job indicated in the selected job indication area 62), whether the button to set a blank space distance between consecutive jobs B1 has been pressed and an inter-job blank space distance between the consecutive jobs has been changed, whether a check state of the consecutive-job check box C1 has been changed, or the like in the job list screen 341 illustrated in FIG. 6 or in the temporarily-stored job list indication area 61 of the job list screen 343 illustrated in FIG. 9.

In the case where a job to be executed has been selected, an inter-job blank space distance has been set for consecutive jobs, or a check state of the consecutive jobs has been changed (Step S1: YES), the control unit 35 determines which job is selected as an execution target from among a single job, a plurality of jobs, and consecutive jobs (Step S2). In the case where no job is selected, the processing ends here.

The single job represents the case where one job is selected as a job to be executed.

The plurality of jobs represents the case where a plurality of jobs is selected as jobs to be executed and consecutive execution of the plurality of jobs is not designated.

The consecutive jobs represent the case where a plurality of jobs is selected as jobs to be executed and consecutive execution of the plurality of jobs is designated.

In the case where the job selected as an execution target is a single job (Step S2: single job), the control unit 35 calculates an image forming distance of the single job, namely, a length in the conveyance direction of the continuous paper P needed to execute the single job (Step S3).

In Step S2, in the case where the job selected as an execution target corresponds to the plurality of jobs (Step S2: plurality of jobs), the control unit 35 calculates an image forming distance per job included in the plurality of jobs (Step S4). A calculation method of the image forming distance per job is the same as a calculation method for the image forming distance of the single job.

Next, the control unit 35 calculates a total image forming distance for the plurality of jobs, namely, a length in the conveyance direction of the continuous paper P needed to execute the plurality of jobs included in the plurality of jobs (Step S5). Specifically, the control unit 35 calculates the total image forming distance by using the second inter-job blank space distance.

In Step S2, in the case where the job selected as an execution target corresponds to the consecutive jobs (Step S2: consecutive jobs), the control unit 35 calculates an image forming distance per job included in the consecutive jobs (Step S6). A calculation method of the image forming distance per job is the same as a calculation method for the image forming distance of the single job.

Next, the control unit 35 calculates a total image forming distance for the consecutive jobs, namely, a length in the conveyance direction of the continuous paper P needed to execute the plurality of jobs included in the consecutive jobs (Step S7). Specifically, the control unit 35 calculates the total image forming distance by using the first inter-job blank space distance, After Step S3, Step S5, or Step S7, the control unit 35 determines whether adjustment timing is included in the calculated image forming distance or total image forming distance (Step S8).

In the case of single job, when the image forming distance of the single job is longer than the consecutive image-forming upper limit distance, adjustment is inserted into a point where image forming by the consecutive image-forming upper limit distance is performed from start of the single job.

In the case of the plurality of jobs, adjustment to be performed between jobs is already included in the total image forming distance. When the image forming distance per job included in the plurality of jobs is longer than the consecutive image-forming upper limit distance, adjustment is inserted into a point where image forming by the consecutive image-forming upper limit distance is performed from start of the plurality of jobs.

In the case of the consecutive jobs, when the total image forming distance for the consecutive jobs is longer than the consecutive image-forming upper limit distance, adjustment is inserted into a point where image forming by the consecutive image-forming upper limit distance is performed from start of the consecutive jobs. In the case of the consecutive jobs, adjustment is not triggered by finish of every job included in the consecutive jobs, but timing when a used paper distance reaches the consecutive image-forming upper limit distance after start of the consecutive jobs may happen to fall between the jobs.

In the case where adjustment timing is included in the calculated image forming distance or total image forming distance (Step S8: YES), the control unit 35 inserts an adjustment distance into the image forming distance or total image forming distance, and updates the image forming distance or total image forming distance (Step S9).

In the case where adjustment timing is not included in the calculated image forming distance or total image forming distance after Step S9 or in Step S8 (Step S8: NO), the control unit 35 calculates a distance to adjustment timing (Step S10).

In the case of the single job, a shorter distance out of the image forming distance of the single job and the consecutive image-forming upper limit distance is adopted as a shortest distance to the adjustment timing.

In the case of the plurality of jobs, a shorter distance out of an image forming distance of a first job and the consecutive image-forming upper limit distance is adopted as a shortest distance to the adjustment timing.

In the case of the consecutive jobs, a shorter distance out of a total image forming distance of the consecutive jobs and the consecutive image-forming upper limit distance is adopted as a shortest distance to the adjustment timing.

Next, the control unit 35 determines whether a scheduled use distance (image forming distance or total image forming distance) is a continuous paper total distance or less (Step S11). The continuous paper total distance can be acquired by subtracting a used distance from an initial value of a preliminarily-registered length in the conveyance direction of the continuous paper P. For example, when a continuous paper P is set in the paper feeding device 10, the continuous paper P of how many meters is set as an initial value of the continuous paper P.

In the case where the scheduled use distance is the continuous paper total distance or less (Step S11: YES), the control unit 35 calculates a remaining distance of the continuous paper P after execution of a selected job by subtracting the scheduled use distance from the continuous paper total distance (Step S12).

In Step S11, in the case where the scheduled use distance is longer than the continuous paper total distance (Step S11: NO), the control unit 35 identifies an executable final job (Step S13).

After Step S12 or Step S13, the control unit 35 performs panel display (Step S14). Specifically, the control unit 35 indicates, on the display unit 34*a*, the image forming distance corresponding to each job, total image forming distance, remaining distance of the continuous paper P after execution of the selected job, distance to the adjustment timing, and the like.

At this point, the job schedule display processing is completed.

In the job list screen 341 illustrated in FIG. 6, a total image forming distance (510 m) is indicated in the total image forming distance indication area 68, an inter-job blank space distance (10 m) in consecutive jobs is indicated in the indication area for a blank space distance between consecutive jobs 64, a continuous paper total distance (430 m) is indicated in the continuous paper total distance indication area 65, and a distance to adjustment (300 m) is indicated in the indication area for a distance to adjustment 67.

Additionally, in the job execution schedule indication area 63, a distance in the conveyance direction of the continuous paper P is set as an axis, an execution schedule of each job is indicated by a length equivalent to an image forming distance corresponding to the job, and also the image forming distance of each job is indicated. Furthermore, a distance to adjustment timing (300 m) and a non-executable job (fourth job) can be recognized from the indication in the job execution schedule indication area 63.

In the job list screen 343 illustrated in FIG. 9, the total image forming distance (350 m) is indicated in the total image forming distance indication area 68, the inter-job blank space distance (10 m) in the consecutive jobs is indicated in the indication area for a blank space distance between consecutive jobs 64, the continuous paper total distance (430 m) is indicated in the continuous paper total distance indication area 65, a remaining distance (80 m) of the continuous paper P after execution of the selected job is indicated in the post-job remaining distance indication area 66, and the distance to adjustment (300 m) is indicated in the indication area for a distance to adjustment 67.

Additionally, in the job execution schedule indication area 63, a distance in the conveyance direction of the continuous paper P is set as an axis, an execution schedule of each job is indicated by a length equivalent to an image forming distance corresponding to the job, and also the image forming distance of each job is indicated. Furthermore, the remaining distance (80 m) of the continuous paper P after execution of the selected job and the distance to the adjustment timing (300 m) can be recognized from the indication in the job execution schedule indication area 63.

As described above, according to the present embodiment, the image forming distance of the selected job is indicated in the image forming device 30 that forms an image on the continuous paper P. Therefore, information related to a use schedule of the continuous paper P accompanied by job execution can be provided.

Additionally, in the case where a plurality of jobs is selected, a total image forming distance corresponding to the plurality of jobs can be indicated.

Furthermore, since the total image forming distance is calculated by using the inter-job blank space distance, the information related to the use schedule of the continuous paper P can be accurately acquired.

Moreover, the number of images that can be subjected to image forming can be notified by indicating the number of images corresponding to an image forming distance instead of the image forming distance.

Additionally, a distance in the conveyance direction of the continuous paper P is set as the axis, and the execution schedule of the selected job is indicated on the axis by using a length equivalent to the image forming distance corresponding to the job. Therefore, the information related to the use schedule of the continuous paper P accompanied by job execution can be provided in a manner visually easily understood.

Furthermore, since the execution schedule of the selected job is indicated in the same screen as a job list to select a job, correlation with a job can be easily grasped.

Meanwhile, note that above descriptions are examples of the image forming device according to one or more embodiments of the present invention, and not limited thereto. A detailed structure of each unit constituting the device and detailed operation thereof can be changed as needed within the range not departing from the gist of the present invention.

For example, described above is the case where an inter-job blank space distance can be changed in the inter-job blank space distance setting screen 342 (refer to FIG. 7) when consecutive jobs are designated for the selected plurality of jobs. However, the inter-job blank space distance may also be changed in the case of the plurality of jobs instead of the consecutive jobs. Additionally, in the plurality of jobs also, the inter-job blank space distance may be indicated, and an operation button to directly transition to a setting screen for the inter-job blank space distance may also be displayed on the screen where the inter-job blank space distance is indicated.

Furthermore, the indication of a job execution schedule in the job execution schedule indication area 63 can be switched not only to the indication using the number of images but also the indication using a value of the total number of images for images formed by executing a selected plurality of jobs or a value of the number of images for images formed until adjustment timing.

Additionally, as described in one or more embodiments above, the control unit 35 integrally controls the entire image forming system 1 as illustrated in FIG. 2, but each one of the paper feeding device 10, paper feeding adjustment device 20, winding adjustment device 40, and winding device 50 may have a structure including an individual control unit.

Furthermore, the image forming device 30 may be a multi-function peripheral (MFP) having a copy function, a scan function, a facsimile function, and the like in addition to the image forming function.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming device comprising:

a conveyance unit that conveys a continuous paper;

an image forming unit that forms an image on the continuous paper;

and a processor that calculates an image forming distance and indicates the calculated image forming distance on a display, wherein:

the image forming distance is a length in a conveyance direction of the continuous paper needed to execute a job, the processor sets a distance in the conveyance direction of the continuous paper as an axis, and the processor displays, on the axis, an execution schedule of the job by using a length equivalent to the image forming distance corresponding to the job on the display.

2. The image forming device according to claim 1, wherein the processor displays, on the axis, the execution schedule of a plurality of jobs and each job of the plurality of jobs is displayed on the axis at the length which is equivalent to an image forming distance corresponding to the job.

3. The image forming device according to claim 2, wherein the processor displays a previously set inter-job blank space distance on the axis.

4. The image forming device according to claim 3, wherein the processor displays the execution schedule of the job and the inter-job space distance so as to be distinguishable.

5. The image forming device according to claim 3, wherein in a case of designating consecutive execution of the plurality of jobs, the processor displays on the axis the inter-job blank space distance by using the preset first inter-job blank space distance, and in a case of not designating consecutive execution of the plurality of jobs, the processor displays on the axis the inter-job bank space distance longer than the preset first inter-job blank distance.

6. The image forming device according to claim 1, wherein the processor displays on the axis a remaining distance of the continuous paper after execution of the job in a recognizable manner.

7. The image forming device according to claim 1, wherein the processor further:

executes an adjustment accompanied by conveyance of the continuous paper, and displays, on the axis, an execution schedule with a distance corresponding to the adjustment.

8. The image forming device according to claim 7, wherein the processor displays the execution schedule of the job and an inter-job space distance so as to be distinguishable.

9. The image forming device according to claim 7, wherein the processor displays:

the execution schedule of the job into which the adjustment is inserted in the middle of the job, and the execution schedule of the job into which the adjustment is not inserted in the middle of the job so as to be distinguishable.

10. The image forming device according to claim 1, wherein:

the processor further displays, on the axis, the execution schedule of the job in response to the job being unable to be executed due to shortage of the continuous paper, and the execution schedule of the job is displayed using a length shorter than the length equivalent to the image forming distance corresponding to the job.

11. The image forming device according to claim 1, wherein the processor further displays:

a first portion of the execution schedule of the job that indicates that the job cannot be executed due to the shortage of the continuous paper, and a second portion of the execution schedule of the job that indicates a portion of the job that can be executed despite the shortage of the continuous paper so as to be distinguishable.

12. The image forming device according to claim 1, wherein when a switch command of the display is received, the processor displays on the axis the execution schedule of the job by a length equivalent to a number of images corresponding to the image forming distance instead of the image forming distance corresponding to the job.

13. The image forming device according to claim 1, wherein the processor displays the execution schedule of the job on a same screen as a job list.

14. The image forming device according to claim 1, further comprising a job selection unit that selects the job to be executed, wherein the processor displays on the axis the execution schedule of the selected job.

15. A non-transitory computer readable medium (CRM) storing computer readable program code for an image forming device, the program code causing the image forming device to execute:

conveying, by a conveyance unit, a continuous paper;

forming, by an image forming unit, an image on the continuous paper;

calculating, by a processor, an image forming distance; and indicating, by the processor, the calculated image forming distance on a display, wherein:

the image forming distance is a length in a conveyance direction of the continuous paper needed to execute a job, the processor sets a distance in the conveyance direction of the continuous paper as an axis, and the processor displays, on the axis, an execution schedule of the job by using a length equivalent to the image forming distance corresponding to the job on the display.

16. The non-transitory CRM-according to claim 15, wherein the program code causes the computer to further execute:

displaying, on the axis, the execution schedule of a plurality of jobs, and displaying each job of the plurality of jobs on the axis at a length which is equivalent to an image forming distance corresponding to the job.

17. The non-transitory CRM of claim 16, wherein the program code causes the computer to further execute:

displaying a previously set inter-job blank space distance on the axis.

18. The non-transitory CRM of claim 15, wherein the program code causes the computer to further execute:

displaying, on the axis, an execution schedule of an adjustment accompanied by conveyance of the continuous paper with a distance corresponding to the adjustment processing.

19. The non-transitory CRM of claim 15, wherein the program code causes the computer to further execute:

displaying the execution schedule of the job on a same screen as a job list.

20. The non-transitory CRM of claim 15, wherein the program code causes the computer to further execute:

selecting the job to be executed; and displaying, on the axis, the execution schedule of the selected job.

* * * * *